US006910797B2

(12) United States Patent
Falcon

(10) Patent No.: US 6,910,797 B2
(45) Date of Patent: Jun. 28, 2005

(54) MIXING DEVICE HAVING SEQUENTIALLY ACTIVATABLE CIRCULATORS

(75) Inventor: Roberto Falcon, Aguadilla, PR (US)

(73) Assignee: Hewlett-Packard Development, L.P., Houston, TX (US)

( * ) Notice: Subject to any disclaimer, the term of this patent is extended or adjusted under 35 U.S.C. 154(b) by 134 days.

(21) Appl. No.: 10/218,875

(22) Filed: Aug. 14, 2002

(65) Prior Publication Data

US 2004/0032793 A1 Feb. 19, 2004

(51) Int. Cl.[7] ..... B01F 11/02

(52) U.S. Cl. ..... 366/127; 366/143; 366/146; 366/154.1; 366/154.2; 366/177.1; 366/181.5; 366/275; 366/366; 366/341

(58) Field of Search ..... 366/127, 143, 366/146, 154.1, 154.2, 177.1, 181.5, 275, 336, 341, 349, DIG. 4

(56) References Cited

U.S. PATENT DOCUMENTS

| | | | | | |
|---|---|---|---|---|---|
| 1,738,565 | A | * | 12/1929 | Claypoole | 516/37 |
| 2,578,505 | A | * | 12/1951 | Carlin | 366/114 |
| 2,702,691 | A | * | 2/1955 | Virmani | 366/127 |
| 2,717,768 | A | * | 9/1955 | Carpentier | 366/114 |
| 4,091,463 | A | | 5/1978 | Tschudy et al. | |
| 5,916,491 | A | | 6/1999 | Hills | |
| 6,019,907 | A | * | 2/2000 | Kawamura | 216/27 |
| 6,097,406 | A | | 8/2000 | Lubinsky et al. | |
| 6,109,744 | A | | 8/2000 | Nishimura | |
| 6,159,442 | A | * | 12/2000 | Thumm et al. | 423/659 |
| 6,170,981 | B1 | | 1/2001 | Regnier et al. | |
| 6,443,611 | B1 | * | 9/2002 | Hasberg et al. | 366/172.1 |
| 6,682,214 | B1 | * | 1/2004 | Vivek et al. | 366/108 |
| 6,719,449 | B1 | * | 4/2004 | Laugharn, Jr. et al. | 366/127 |
| 6,726,308 | B2 | * | 4/2004 | Lee et al. | 347/48 |
| 2001/0010661 | A1 | | 8/2001 | Schembri | |

FOREIGN PATENT DOCUMENTS

| | | |
|---|---|---|
| EP | 1 302 321 | 4/2003 |
| JP | 2002103592 | 4/2002 |
| WO | WO 00/62913 | 10/2000 |

OTHER PUBLICATIONS

Patent Abstracts of Japan, Abstract of JP 2002103592A, Apr. 2002.

Copy of full Search Report for United Kingdom Patent Application No. 0318099.9, mailed on Jan. 30, 2004.

* cited by examiner

*Primary Examiner*—David Sorkin

(57) ABSTRACT

A mixing device includes a mixing chamber, inlet and outlet paths, and circulators adapted to change shape or temperature in response to electric current. The change in shape or temperature causes substances to circulate within the mixing chamber to form a mixture. The circulators include heating elements such as resistors, and/or piezoelectric devices or other devices. Mixing systems and methods also are disclosed.

23 Claims, 7 Drawing Sheets

MIXING DEVICE HAVING SEQUENTIALLY ACTIVATABLE CIRCULATORS

BACKGROUND OF THE INVENTION

Drop-on-demand inkjet printers use printhead nozzles that each eject a single drop of ink only when activated. Thermal inkjet and piezoelectric inkjet are two common drop-on-demand inkjet technologies.

Thermal inkjet printers use heat to generate vapor bubbles, ejecting small drops of ink through nozzles and placing them precisely on a surface to form text or images. Advantages of thermal inkjet printers include small drop sizes, high printhead operating frequency, excellent system reliability and highly controlled ink drop placement. Integrated electronics mean fewer electrical connections, faster operation and higher color resolution. Originally developed for desktop printers, thermal inkjet technology is designed to be inexpensive, quiet and easy to use.

FIGS. 1–2 illustrate a known thermal inkjet 10. Inkjet 10 includes a silicon substrate 12 that supports thin-film conductor 14 and thin-film resistor 16. An opening in photoimageable polymer barrier 18 defines firing chamber 20, which is fluidly coupled with ink channel 22 for holding ink 24. Orifice plate 26 defines ink channel orifice 28. Resistor 16 is located in the center of the floor of firing chamber 20, and upon application of electricity rapidly heats a thin layer of ink 24. A tiny fraction of ink 24 is vaporized to form expanding bubble 30 that ejects drop 32 of ink onto a print medium such as paper. Refill ink 34 is drawn into firing chamber 20 automatically for subsequent drop formation and ejection. Multiple inkjets 10 generally are disposed for ejecting ink drops through multiple orifices 28 in a single orifice plate 26.

More specifically, as shown in FIGS. 3–6, resistor 16 heats ink at more than one hundred Centigrade degrees per microsecond, causing bubble nucleation shown generally at 35 in FIG. 3 in less than about 3 microseconds. Bubble 30 expands, forming drop 32 as shown in FIG. 4, at about 3–10 microseconds from start. Bubble collapse and drop break-off occur at about 10–20 microseconds from start, as shown in FIG. 5, ejecting drop 32 and drawing in fresh refill ink 34. An ink meniscus in orifice 28 settles and ink refill completes, as shown in FIG. 6, in less than about 80 microseconds from start. Inkjet 10 heats a thin film of ink about 0.1 micrometers thick to about 340 degrees Celsius. The ink does not boil; expanding vapor bubble 30 forms to expel the ink. No moving parts are used except the ink itself.

Inkjet 10 of FIGS. 1–6 is a top-ejecting inkjet, in that orifice 28 is located above resistor 16. Other inkjet configurations are known. In side-ejecting inkjet 36 illustrated schematically in FIG. 7 in partially cut-away form, for example, orifice 38 is located to the side of resistor 16 instead of above it. FIG. 8 shows another side-ejecting inkjet 40. To simplify the disclosure, certain similar elements in FIGS. 1–8 have the same reference numerals even though those elements may not be exactly identical structurally.

FIGS. 9–10 show an example of a piezoelectric inkjet 50. Inkjet 50 uses piezoelectric transducer 52, shown in an undeflected configuration in FIG. 9, to push and pull diaphragm 54 adjacent firing chamber 56. Upon application of electricity, the resulting physical displacement (FIG. 10) of transducer 52 and diaphragm 54 ejects ink drop 58 through orifice 60. Refill ink 62 is drawn through ink channel 64 for subsequent drop formation and ejection. Inkjet 50 thus mechanically moves the mass of diaphragm 54 and the ink in firing chamber 56. Mechanical manufacturing processes typically are used to create compared to thermal inkjets.

SUMMARY OF THE INVENTION

A mixing device includes a mixing chamber, at least one inlet path for directing a first substance and a second substance to the mixing chamber, a plurality of circulators disposed within the mixing chamber, and at least one outlet path for directing a mixture of the first and second substances away from the mixing chamber. The circulators are adapted to change shape or temperature in response to electric current, the change in shape or temperature causing the first substance and the second substance to circulate within the mixing chamber to form the mixture of the first and second substances.

BRIEF DESCRIPTION OF THE DRAWINGS

The accompanying drawings illustrate embodiments of the present invention and together with the description serve to explain certain principles of the invention. Other embodiments of the present invention will be readily appreciated with reference to the drawings and the description, in which like reference numerals designate like parts and in which.

DETAILED DESCRIPTION OF PREFERRED EMBODIMENTS

Figure 1:
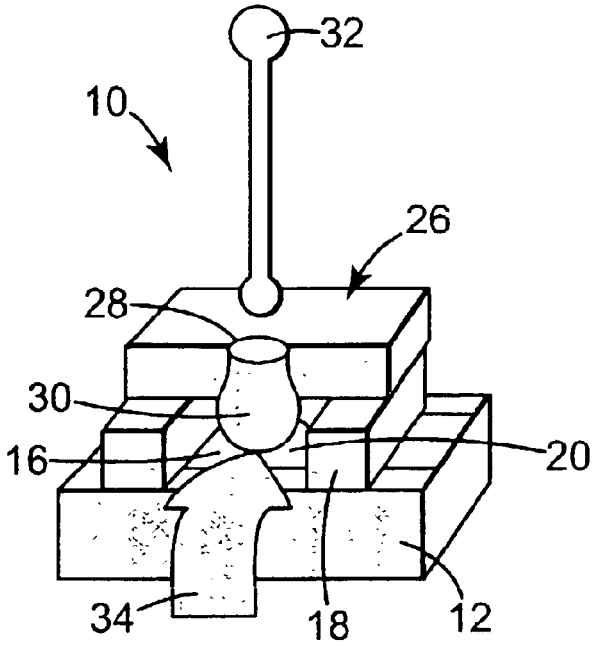
Fig. 1 (PRIOR ART)
FIG. 1 is a perspective, partially cut-away view of a prior-art top-ejecting thermal inkjet.
Figure 2:
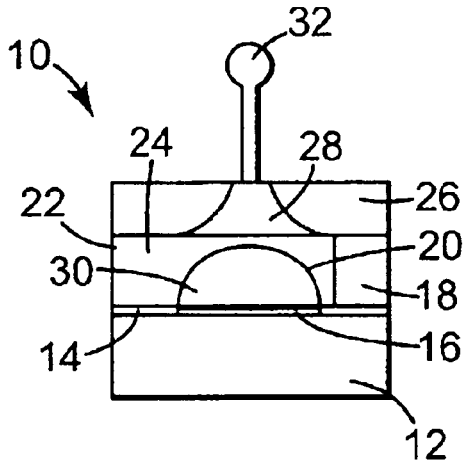
Fig. 2 (PRIOR ART)
FIG. 2 is a side view of the FIG. 1 inkjet.
Figure 3:
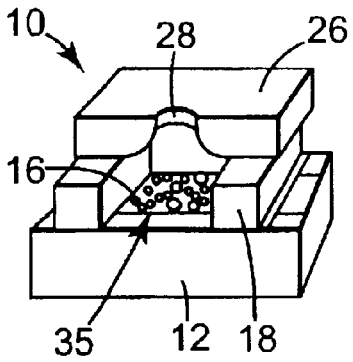
Fig. 3 (PRIOR ART)
FIGS. 3–6 are perspective views of the FIG. 1 inkjet in different stages of drop formation and ejection.
Figure 4:
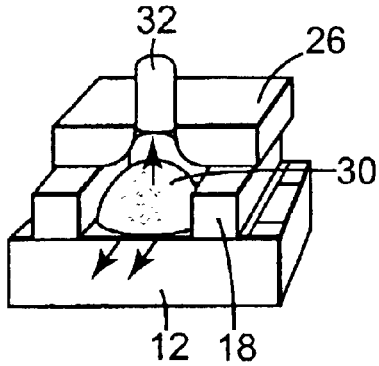
Fig. 4 (PRIOR ART)
Figure 5:
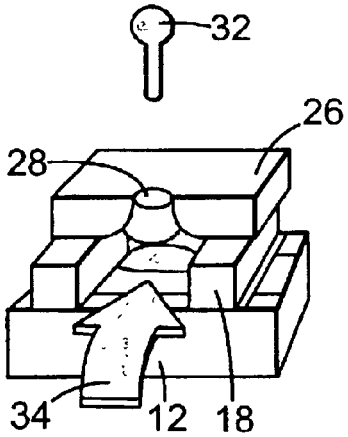
Fig. 5 (PRIOR ART)
Figure 6:
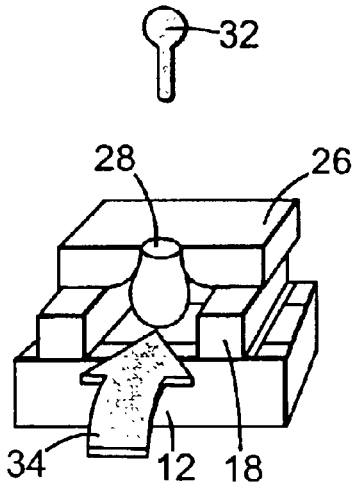
Fig. 6 (PRIOR ART)
Figure 7:
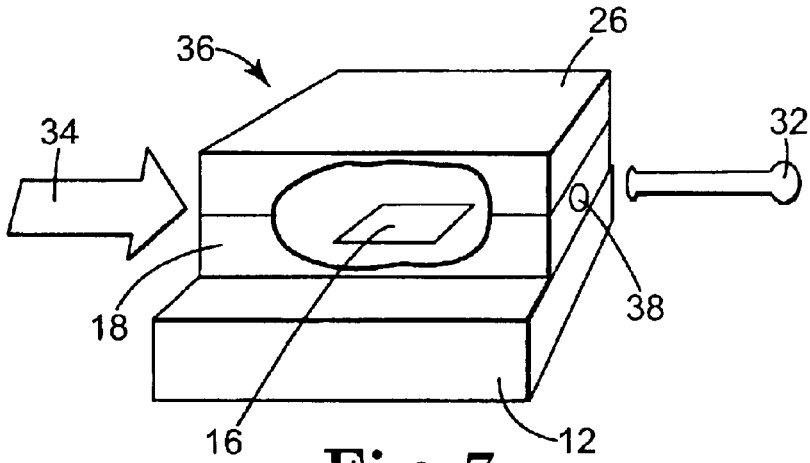
Fig. 7 (PRIOR ART)
FIG. 7 is a partially cut-away view of a prior-art side-ejecting thermal inkjet.
Figure 8:
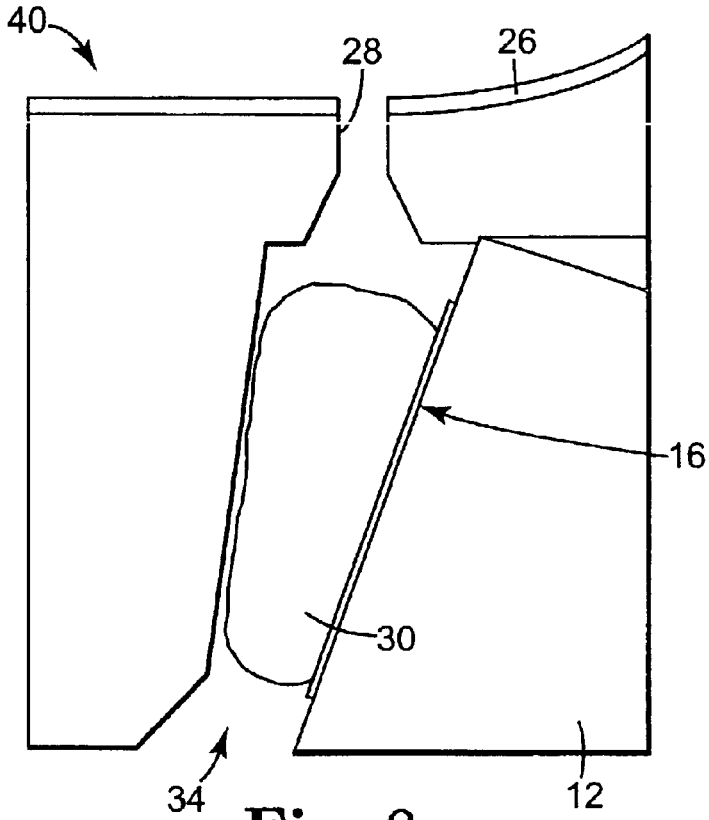
Fig. 8 (PRIOR ART)
FIG. 8 is a top view of a prior-art side-ejecting thermal inkjet.
Figure 9:
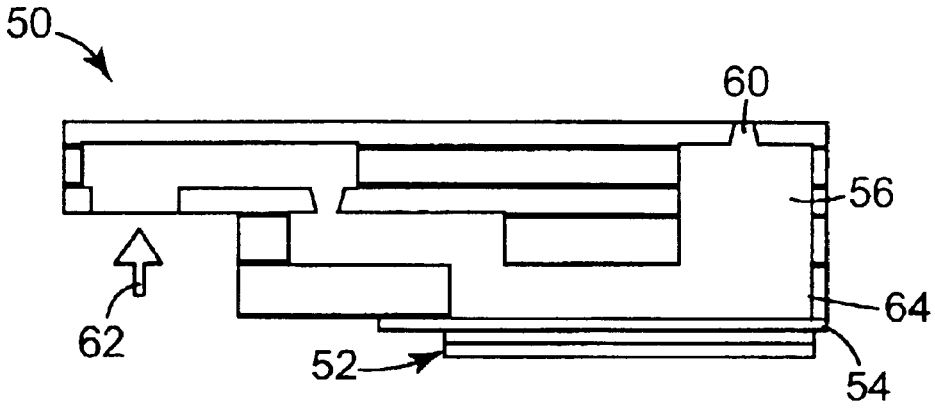
Fig. 9 (PRIOR ART)
FIGS. 9–10 are side views of a prior-art piezoelectric inkjet.
Figure 10:
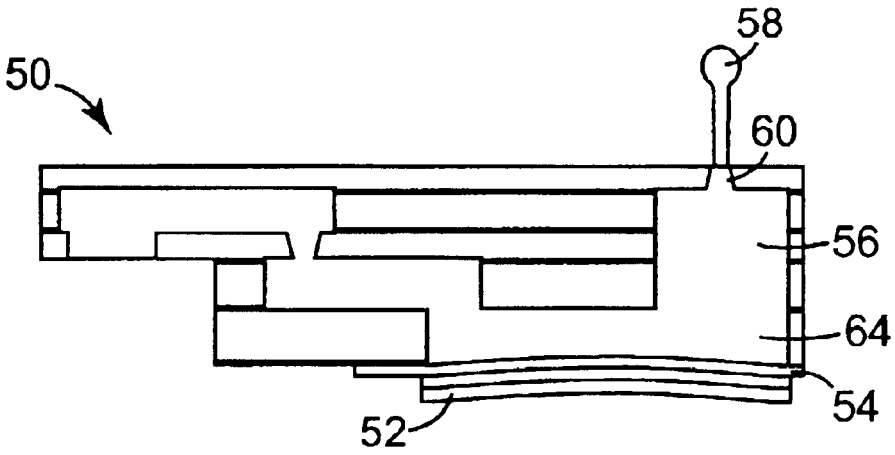
Fig. 10 (PRIOR ART)
Figure 11:
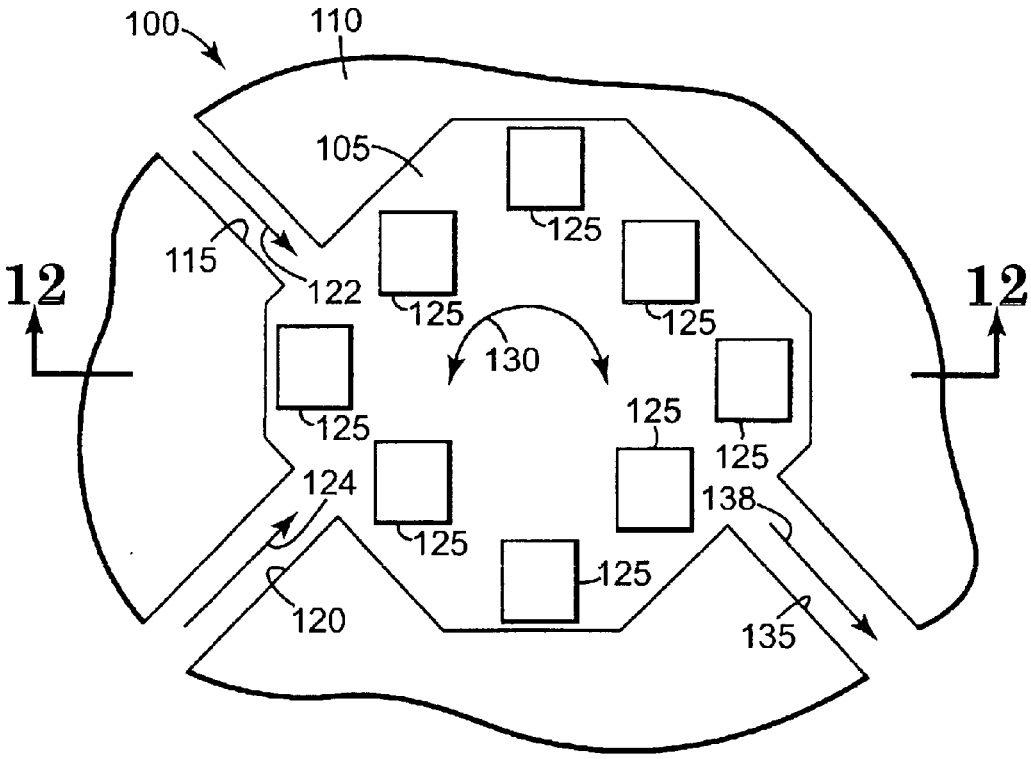
FIG. 11 is a top view of a mixing device according to an embodiment of the invention.
Figure 12:
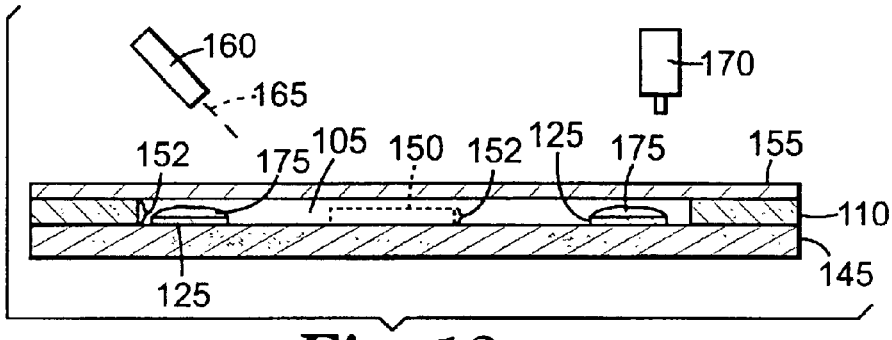
FIG. 12 is a partially schematic cross-sectional view taken along line 12—12 of FIG. 11.
Figure 13:
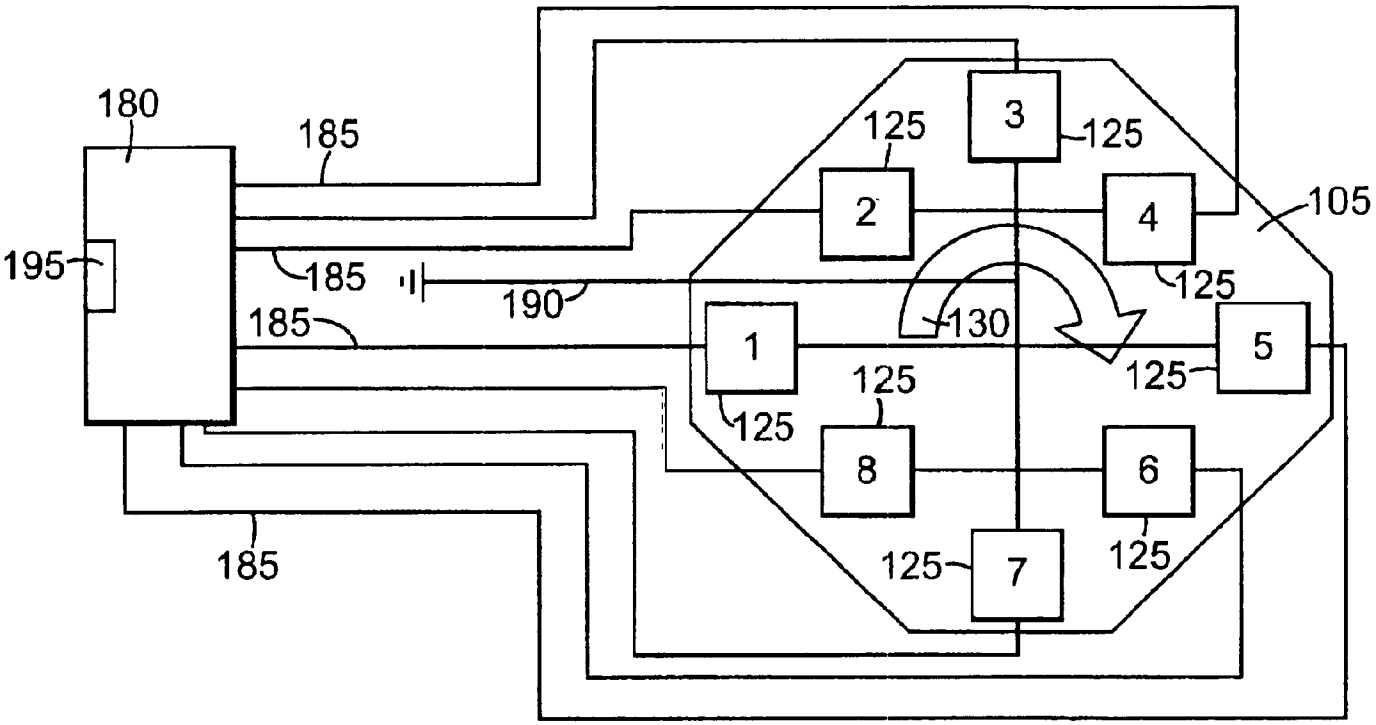
FIG. 13 is a top schematic view of a mixing device according to an embodiment of the invention.

With reference to e.g. FIGS. 11–13, mixing device 100 according to an embodiment of the invention includes mixing chamber 105. Mixing chamber 105 optionally is defined, at least in part, within layer 110 of a photolithographic or photoimageable material. Those skilled in the art will appreciate, upon reading this disclosure, the various ways in which layer 110 can be deposited and/or etched to form mixing chamber 105. Layer 110 also defines or partly defines inlet channels or paths 115, 120, for directing first and second substances to mixing chamber 105, as denoted by arrows 122, 124. The invention is not limited to two such paths; any number of inlet paths optionally are provided. For example, mixing device 100 optionally includes only one inlet path 115, with multiple substances being introduced to mixing chamber 105 sequentially or simultaneously along path 115. More than two inlet paths optionally are provided for example three, four, five or more paths, to introduce multiple substances to mixing chamber 105.

One or more circulators 125 are disposed within mixing chamber 105. Circulators 125 are adapted to change shape or temperature in response to electric current, according to certain embodiments of the invention. The change in shape or temperature causes e.g. the first substance and the second substance to circulate, as indicated by arrow 130, within mixing chamber 105 to form a mixture of the first substance and second substance. As will be described, the invention contemplates multiple different circulation patterns. Clockwise circulation, counterclockwise circulation, circulation in both directions, linear/radial circulation, and combinations thereof are among the circulation patterns contemplated by the invention. As also will be described, circulators 125 according to selected aspects of the invention optionally include heating elements to form vapor bubbles within mixing chamber 105, for example thin-film resistors, to promote circulation and mixing. According to additional aspects, circulators 125 optionally include piezoelectric transducers or other promoting circulation and mixing. Each circulator 125 optionally includes heating, deflection, or other technology illustrated and described with respect to FIGS. 1–10, or other technology.

In the case where circulators 125 are resistors, a layer of tantalum material or other relatively inert and strong material optionally is deposited on the exposed resistor surface, according to embodiments of the invention, chemically isolating the resistor from the substances to be mixed. The resistors and the substance being mixed thus are both protected. Of course, other isolating substances are contemplated for use in connection with resistors, or the resistors can be free of such substances.

Outlet path 135 directs the mixture away from mixing chamber 105, as indicated by arrow 138. As with inlet paths 115, 120, multiple outlet paths 135 optionally are provided, if desired, and the outlet path(s) optionally are defined, at least in part, by structure other than layer 110.

Layer 110 of photoimageable material is deposited on substrate 145, for example a silicon substrate, using photodeposition techniques or other techniques to at least partially form mixing chambers 105 and/or paths 115, 120 and/or 135. Alternatively, mixing chamber 105 and/or the paths optionally are defined by mechanically constructed or formed structure instead of chemically deposited structure. In either case, one or more "islands" or other structures 150 optionally are disposed in mixing chamber 105, such that the introduced substances circulate around island 150. Island 150 optionally extends partially across the height of chamber 105 in the illustrated embodiment, or optionally extends entirely to cover 155, if desired. Additionally, to promote mixing, the top and/or sides of island 150, chamber 105, or other exposed surfaces within or along mixing chamber 105, optionally define an etch or rough surface 152, according to embodiments of the invention. Roughness 152 also is optionally incorporated into paths 115, 120, 135. Island 150, roughness 152, and/or other features generate internal eddies or eddy currents, for example, adding turbulence to disrupt smooth flow and promote even and thorough mixing.

In the illustrated embodiment, mixing chamber 105 is covered by, otherwise bordered by, or adjacent to cover 155. Cover 155 is transparent or translucent, according to embodiments of the invention, to provide viewing into mixing chamber 105. Mixing device 100 optionally is combined with laser or other light or energy source 160 for emitting laser light or other energy 165 into mixing chamber 105 through cover 155 or along an alternative path. Microscope 170 or other viewing device also is provided for viewing mixing chamber 105 or energy emanating therefrom. For example, device 170 is used to view or measure a change in wavelength or another characteristic or response caused when light or energy of a particular wavelength or other characteristic is introduced into mixing chamber 105. Device 170 thus is used in analyzing or viewing the substance(s) or mixture in mixing chamber 105. For example, measuring the changed wavelength of light or other physical characteristic as viewed through cover 155 optionally is used to determine whether an additional quantity of one or more substances needs to be introduced, whether the resulting mixture has been mixed well enough, etc. As another example, viewing device 170 determines whether a color change, temperature change, or other change has occurred to analyze whether the mixing process is complete or needs to be adjusted. Viewing device 170 also optionally is used to determine whether temperature thresholds, light thresholds, or other thresholds have been met or exceeded.

According to the illustrated embodiment, inlet path(s) 115, 120 and outlet path(s) 135 are non-overlapping. According to alternative embodiments, one or more of paths 115, 120, 135 do overlap, i.e. are used both to introduce substances to be mixed and to withdraw the mixed substances. One or more of paths 115, 120, 135 directs flow by capillary action, if desired. Additionally, or alternatively, separate pumping devices are contemplated for directing flow along the paths, as are one or more valve devices or other devices to prevent backflow or otherwise undesired flow. By controlling injection and ejection pressure differential using e.g. capillary effects, external pumps or other devices, substances move into and out of mixing area 105 at controlled rates.

According to certain aspects of the invention, as mentioned above, circulators 125 comprise resistors or other heating elements adapted to form vapor bubbles 175, for example generally in the manner of thermal inkjets. Temperatures on the exposed surface of the resistors reach 600–800 degrees Celsius, for example, resulting in rapid formation of bubbles 175 and consequent mix introduced substances together. According to alternative embodiments, circulators 125 comprise piezoelectric devices, for example generally in the manner of piezoelectric inkjets. In those cases, vapor bubble formation and/or deflection of the piezoelectric transducing portion of each circulator 125 in response to electric current causes a pressure wave or other disturbance within mixing chamber 105. Other circulators, for example mechanically actuated circulators, are contemplated as well. For purposes of illustration, circulators 125 in FIG. 12 are disposed above the upper surface of substrate 145. However, the invention also contemplates disposing circulators 125 entirely or partially within substrate 145, and/or electrically connecting circulators 125 to a conducting layer supported by or in substrate 145. Sequential or simultaneous firing or activation of circulators 125 produces circulation within mixing chamber 105 to promote mixing or other combination of introduced substances.

FIG. 11 illustrates eight separate circulators 125 arranged in a generally circular or generally diamond-shaped pattern, but the invention is not limited to eight circulators or the illustrated pattern. Any number of circulators 125 optionally are provided, disposed in any desired pattern, as appropriate for a particular use or environment for which mixing device 100 is intended. Circular, square triangular or other arrangements of any integer number greater than or less than eight circulators are contemplated. Embodiments of the invention also contemplate different activation sequences for circulators 125, as now will be described with respect to FIG. 13.

FIG. 13 shows processing device 180 connected or otherwise operably coupled with circulators 125 by power (firing) lines 185. Ground line 190 also is connected or otherwise operably coupled with circulators 125. Processing device 180 fires circulators 125 according to a desired speed, direction, time and/or other parameter(s) depending on the particular substances being mixed or other factors. FIG. 13 also shows one particular firing sequence of circulators 125, as indicated by firing-order numbers 1–8 illustrated within each circulator 125. Thus, processing device 180 controls circulators 125 to sequentially fire generally around the circumference of mixing chamber 105 to create circulation pattern 130. Processing device 180 independently controls or activates circulators 125 in any desired manner. For example, one or more of circulators 125 optionally are fired simultaneously, e.g. around the circumference of mixing chamber 105 in pairs, to promote a desired circulation pattern. The firing order and thus the direction and nature of circulation also optionally are reversed one or more times. Firing one-half or some other portion of circulators 125 alternately with an oppositely disposed half or other portion of circulators 125 induces a partial or total side-to-side motion. Firing all circulators 125 simultaneously induces a pressure wave directed toward the center of mixing chamber 105, concentrating the substances to be mixed in a central portion thereof. Circulators 125 nearest an inlet path optionally are fired sooner than or otherwise in relation to circulators 125 nearest an outlet path, to induce flow from the inlet path toward the outlet path. One or more circulators 125 optionally have totally or partially overlapping firing periods, e.g. to better induce flow in a desired direction. By activating circulators 125 in a desired sequence or series, with optional overlap in firing between one or more adjacent or otherwise disposed circulators, an initial stepping movement of the substance(s) in mixing chamber 105 quickly develops into a fast, continuous and circular movement, for example. Those of ordinary skill will appreciate the wide variety of pressure waves, wave patterns, and wave strengths that are attained according to embodiments of the invention, and the many combinations and permutations of firing sequences that are capable of implementation by processing device 180.

One or more firing routines are stored within memory 195 associated with processing device 180. Memory 195 also stores features such as time parameters, look-up tables, speed requirements, direction requirements, liquid viscosities, etc. Viewing device 170 or another sensing device optionally is associated with processing device 180, to sense the type of introduced substances or type of mixture and to automatically determine and/or indicate the firing sequence or pattern that processing device 180 applies to circulators 125. Processing device 180 is freely programmable, according to embodiments of the invention, to activate circulators 125 in a desired manner.

Figure 14:
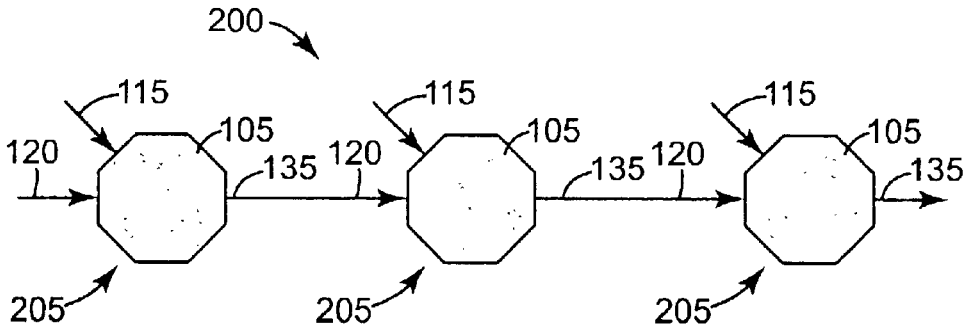
FIG. 14 shows a mixing system according to an embodiment of the invention.

Multiple mixing chambers 105 optionally are combined in series and/or parallel to achieve a desired mixing result, according to embodiments of the invention. FIG. 14, for example, shows mixing system 200 comprising a plurality of mixing stages 205 in fluid communication with each other. Each mixing stage 205 includes mixing chamber 105 with one or more associated inlet paths 115, 120 and one or more outlet paths 135. Each mixing stage 205 is adapted to mix introduced substances together, using either heat-induced bubble formation or piezoelectric action, for example. One or more circulators 125 described with reference to previous embodiments are used for this purpose.

Figure 15:
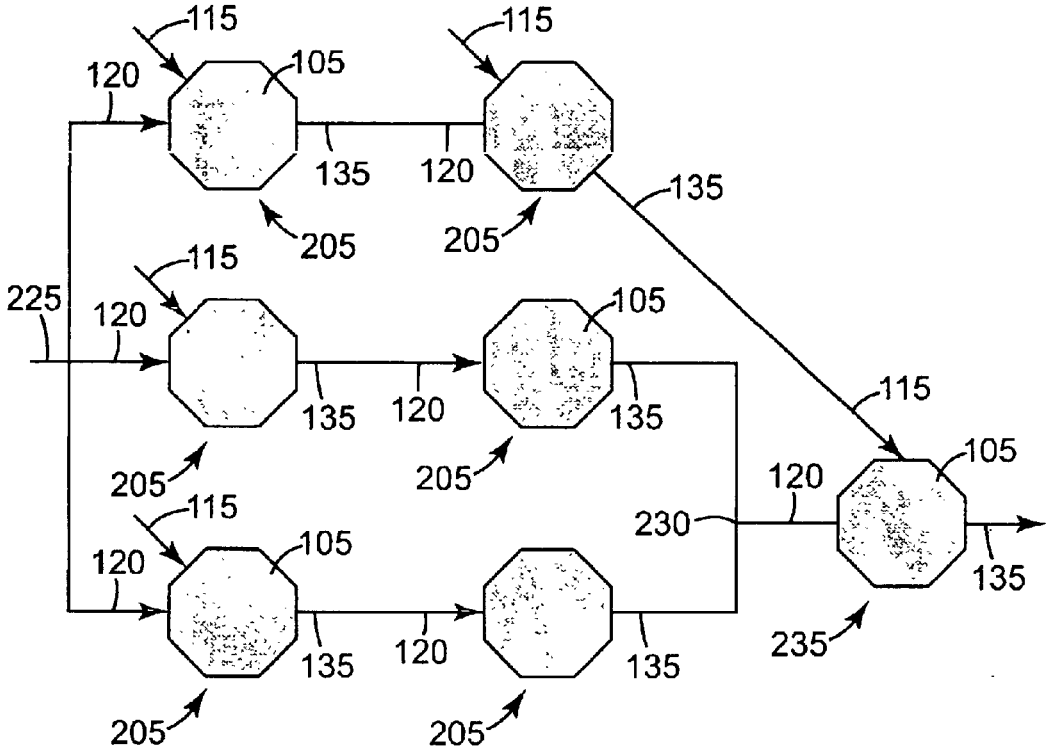
FIG. 15 shows another mixing system according to an embodiment of the invention.

System 200 of FIG. 14 includes mixing stages 205 arranged in series, such that output or output path 135 of an upstream mixing stage serves as an input or input path 120 to a downstream mixing stage, as shown. FIG. 15 illustrates a more complex system 220, in which pairs of stages 205 are arranged in parallel. Each pair of mixing stages arranged in parallel has a common input 225 that supplies input paths 120. Two mixing stage outputs or output paths 135 are combined at 230, for example, providing a common input to final mixing stage 235. Output path 135 from final stage 235 acts as a final output of system 220. As with previous embodiments, one or more processing devices 180 optionally are associated with each mixing stage 205, or combinations of mixing stages 205. Portions or all of systems 200, 220 are combined on a single chip, according to embodiments of the invention, such that relatively complex micro-fluidic mixing occurs on a very small scale. Each mixing stage includes a plurality of fluid movement devices, for example in the manner of previously described circulators 125, adapted to change temperature or shape in response to electric current and consequently to mix the introduced liquids together, for example.

A mixing method according to embodiments of the invention includes providing a first substance and second substance in mixing area 105, and using independently controlled heating elements 125 to form a plurality of separate bubbles 175 in mixing area 105. Bubbles 175 cause the first substance and second substance to mix together in mixing area 105. Particular embodiments of the invention include reversing a direction of flow 130 within mixing area 105, and introducing a cleaning substance in mixing area 105 to clean mixing area 105. Cleaning substances such as softened water, alcohol, and/or other solvents are among those contemplated for use.

Those of ordinary skill will appreciate upon reading this disclosure the wide variety of substances that are mixable, according to embodiments of the invention. One or both of the first and second substances includes a liquid, a powder, one or more inks or other printing fluids, a blood product, a chemical reagent for reacting with a blood product, and/or a cleaning agent, for example. Embodiments of the invention also are used to mix oil and water, for example, or other substances that are not readily perceived as combinable. According to additional embodiments, mixing device 100 comprises means 115 and/or 120 for providing first and second liquids to mixing area 105, means 125 for moving first and second liquids within mixing area 105 to form a mixture, the means 125 for moving comprising means for changing shape or temperature in response to electric current. Means 125 for moving, for example, comprises means for creating at least one bubble 175 within mixing area 105 using heat, according to one embodiment. Means 125 for moving also comprises means for creating displacement using piezoelectric effect, according to alternative embodiments. Resistive and piezoelectric circulators 125 as described herein optionally are used together in one mixing chamber 105, if desired. Means 180 for programmably activating means 125 for moving also is provided. Means 135 is provided for removing the mixture from mixing area 105.

Embodiments of the invention are adapted for application on a very small scale, such that micro-fluidic mixing of liquids or other substances is achieved. For example, each circulator is about 60 microns or smaller on each side, with a surface power density of e.g. about 1.28 billion watts per square meter. According to one embodiment, mixing chamber 105 is about 300 microns by about 300 microns in diameter, and about 25 to about 50 microns in height, thereby providing a very small mixing volume. Each inlet channel and outlet channel 115, 120, 135 also optionally is constructed of desired height and width dimensions, in the range of e.g. about 50 microns, about 100 microns, or larger or smaller dimensions. Effective mixing of minute volumes thus is achieved very rapidly. Of course, smaller and larger dimensions according to embodiments of the invention are contemplated. Processing device 180, mixing chamber 105 and the other associated components are provided on a single chip, according to aspects of the invention. Alternatively, processing device 180 and associated components are part of an external computer system or external chip, according to embodiments of the invention.

The small scale contemplated according to embodiments of the invention allows mixing device 100 to be incorporated easily into multiple pre-existing devices or new devices or environments. For example, devices or kits for testing or mixing blood, saliva, blood reagents and other reagents, pollutants, toxins, naturally occurring water or environmentally related substances, ink or other printing fluids, pharmaceuticals, etc. are contemplated. According to a medical or blood-testing embodiment of the invention, a single drop of blood or other medical substance to be tested is divided with capillary devices into different mixing chambers 105, and then mixed with one or more reagents or other reagents or other substances to provide different test results. Such results are monitored at one or more of mixing stages 205, and/or at final mixing stage 235. Each stage or mixing device or series of mixing devices is optionally associated with a different test parameter, e.g. blood glucose, cholesterol, etc., with a glucose response being measured in one stage 205, a cholesterol response in another stage 205, etc. Microanalysis is done "on the spot," using minute amounts of substance for testing, without the need for bulky or otherwise relatively immobile machinery, if desired.

Although the present invention has been described with reference to certain embodiments, those skilled in the art will recognize that changes may be made in form and detail without departing from the spirit and scope of the invention. For example, the drawings associated with this disclosure are not necessarily to scale. The term "mixture" is not necessarily limited to a mixture according to a strictly chemical definition, but optionally is interpreted broadly enough to include suspensions, combinations, compounds, etc. Finally, it should be understood that directional terminology, such as upper, lower, left, right, over, under, above, and below is used for purposes of illustration and description only, and is not intended necessarily to be limiting. Other aspects of the invention will be apparent to those of ordinary skill.

What is claimed is:

1. A mixing device, comprising:

a mixing chamber;

at least one inlet path for directing a first substance and a second substance to the mixing chamber, the first substance being different than the second substance;

a plurality of circulators disposed within the mixing chamber, the circulators being adapted to change shape or temperature in response to electric current, the change in shape or temperature causing the first substance and the second substance to circulate within the mixing chamber to form a mixture of the first substance and second substance; and at least one outlet path for directing the mixture away from the mixing chamber;

wherein the circulators are coplanar with each other and with the at least one inlet path; further wherein the circulators are arranged in a generally circular pattern and are adapted for activation in a predetermined sequence to create a vortex within the mixing chamber.

2. The mixing device of claim 1, wherein the mixing chamber is defined within a photoimageable material.

3. The mixing device of claim 1, wherein the mixing chamber is bordered by a silicon substrate.

4. The mixing device of claim 1, further comprising an island disposed in the mixing chamber such that the first substance and the second substance circulate around the island.

5. The mixing device of claim 1, wherein the mixing chamber is bordered by a transparent or translucent cover to provide viewing into the mixing chamber.

6. The mixing device of claim 5, in combination with a microscope for viewing the mixing chamber.

7. The mixing device of claim 5, in combination with a laser source for emitting laser light into the mixing chamber.

8. The mixing device of claim 1, wherein a border of the mixing chamber defines a rough surface exposed to the mixing chamber to promote mixing of the first substance and the second substance.

9. The mixing device of claim 1, wherein each circulator is less than about 60 microns in diameter.

10. The mixing device of claim 1, wherein the at least one inlet path and the at least one outlet path are non-overlapping.

11. The mixing device of claim 1, wherein the at least one inlet path is adapted to direct the first substance and the second substance by capillary action.

12. The mixing device of claim 1, wherein the at least one inlet path comprises a plurality of inlet paths.

13. The mixing device of claim 1, wherein the circulators comprise heating elements adapted to form vapor bubbles to circulate the first substance and the second substance within the mixing chamber.

14. The mixing device of claim 13, wherein the heating elements comprise resistors.

15. The mixing device of claim 13, wherein the at least one inlet path and the at least one outlet path are coplanar.

16. The mixing device of claim 13, further comprising an island disposed in the mixing chamber such that the first substance and the second substance circulate around the island.

17. The mixing device of claim 1, wherein the circulators comprise piezoelectric devices.

18. The mixing device of claim 1, wherein the circulators are adapted for independent activation in a predetermined sequence.

19. The mixing device of claim 1, further in combination with a processing device operably coupled with the circulators to control activation of the circulators.

20. The mixing device of claim 1, wherein the plurality of circulators comprise at least three circulators disposed within the mixing chamber.

21. A mixing device, comprising:

means for separately providing different first and second liquids to a mixing area;

means for moving the first and second liquids within the mixing area to form a mixture, the means for moving comprising means for changing shape or temperature in response to electric current;

means for removing the mixture from the mixing area; and programmable means for activating the means for moving wherein the programmable means is adapted to activate the means for moving in a first sequence to move the first and second liquids within the mixing area in a first direction; further wherein the programmable means is adapted to activate the means for moving in a second sequence opposite to the first sequence to move the first and second liquids in a second direction opposite to the first direction.

22. The mixing device of claim 21, wherein the means for moving comprises means for creating at least one bubble within the mixing area using heat.

23. The mixing device of claim 21, wherein the means for moving comprises means for creating displacement using piezoelectric effect.

* * * * *

UNITED STATES PATENT AND TRADEMARK OFFICE

CERTIFICATE OF CORRECTION

PATENT NO. : 6,910,797 B2
APPLICATION NO. : 10/218875
DATED : June 28, 2005
INVENTOR(S) : Roberto Falcon It is certified that error appears in the above-identified patent and that said Letters Patent is hereby corrected as shown below:

IN THE SPECIFICATION

Column 2, line 2, after "create" and before "compared" insert --inkjet 50, generally resulting in relatively lower nozzle or orifice density--

Column 4, line 39, after "consequent" insert --mixing. According to these embodiments, no moving parts need be employed to--

Signed and Sealed this

Twenty-sixth Day of June, 2007

JON W. DUDAS
*Director of the United States Patent and Trademark Office*